US005108210A

United States Patent [19]

Hirano et al.

[11] Patent Number: 5,108,210

[45] Date of Patent: Apr. 28, 1992

[54] PRINTER HAVING MULTIPLE TRACTOR MOUNTING CONFIGURATIONS

[75] Inventors: Seiichi Hirano; Kouichirou Yokoyama; Tatsuya Seshimo; Susumu Murayama; Kazuhiko Yamaguchi, all of Nagano, Japan

[73] Assignee: Seiko Epson Corporation, Tokyo, Japan

[21] Appl. No.: 651,862

[22] Filed: Feb. 7, 1991

[30] Foreign Application Priority Data

Feb. 19, 1990 [JP] Japan ..... 2-39011

[51] Int. Cl.[5] ..... B41J 11/24

[52] U.S. Cl. ..... 400/616.1; 400/611; 400/569; 400/692; 226/74; 226/110

[58] Field of Search ..... 400/611, 616, 616.1, 400/616.2, 616.3, 569, 692; 226/74, 110

[56] References Cited

U.S. PATENT DOCUMENTS

| | | | |
|---|---|---|---|
| 4,571,103 | 2/1986 | Takeo | 400/616.1 |
| 4,742,946 | 5/1988 | Hamamichi | 400/616.2 |
| 4,953,997 | 9/1990 | Hasegawa | 400/616.3 |
| 4,974,979 | 12/1990 | Cardenas | 400/616.1 |
| 4,988,226 | 1/1991 | Ito | 400/616.1 |

FOREIGN PATENT DOCUMENTS

| | | | |
|---|---|---|---|
| 0191984 | 5/1985 | European Pat. Off. . | |
| 61-120779 | 6/1986 | Japan . | |
| 220873 | 10/1986 | Japan | 400/616 |
| 233275 | 10/1987 | Japan | 400/616 |
| 2026949 | 2/1980 | United Kingdom | 400/616.3 |

*Primary Examiner*—Edgar S. Burr
*Assistant Examiner*—Eric P. Raciti
*Attorney, Agent, or Firm*—Sughrue, Mion, Zinn, Macpeak & Seas

[57] ABSTRACT

A printer including at least two tractor unit mounting sections upstream of the print position in the sheet feed direction, and at least one tractor unit can be mounted on either of these tractor unit mounting sections. The sheet feeding direction can thus be selected freely in accordance with the web replacement frequency or the printer installation location merely by changing the mounting position of the tractor unit. If the number of tractor units is increased, a plurality of webs can be set up simultaneously and used selectively.

7 Claims, 3 Drawing Sheets

PRINTER HAVING MULTIPLE TRACTOR MOUNTING CONFIGURATIONS

BACKGROUND OF THE INVENTION

The invention relates to printers, and more particularly to a printer capable of arbitrarily changing the mounting position and number of tractor units.

Printers using a long sheet, i.e., a continuous web, include one in which a push-type pin tractor is disposed at the rear of the print position, as disclosed in Japanese Patent Unexamined Publication No. 71453/86, and one in which the push-type pin tractor is disposed in front of the print position, as proposed in Japanese Patent Unexamined Publication No. 163084/1989.

The former type of printer has the advantages that the web does not pass through the front of the printer, the printer can be installed on a Computer body or monitor, and the web can be located at the rear of the computer or on the floor, making it suitable for use in small space. However, its disadvantage is that replacement of the paper web is not easy. On the other hand, the latter type printer has the advantage that the web can be replaced from the front of the printer, but it also has the disadvantage that the location of the printer or web is limited because the web passes through the printer in the front, thereby making it unsuitable for use in a small space.

To solve the above problems, a printer such as disclosed in Japanese Patent Unexamined Publication No. 8070/1989 has two push-type pin tractors in front and at the rear of the print position. In this type of printer, however, the pin tractors cannot be detached, even though they may not be used depending on printing requirements. Thus, the printer is too expensive for some applications.

SUMMARY OF THE INVENTION

The invention has been made in view of the above problems, and has as an object the provision of a printer in which the sheet feed path can be easily changed in accordance with the location of installation.

Achieving the above object, the invention provides a printer which comprises at least two tractor unit mounting sections upstream of a print position in a sheet feed direction, means for transmitting a drive force to each of the tractor unit mounting sections, and at least one tractor unit removably mounted on each of the tractor unit mounting sections and coupled with one of the drive force transmitting means at the time the tractor unit is mounted on the printer.

With the above construction, sheets can be fed from any direction suitable for the installation of the printer merely by changing the mounting position of the tractor unit. In addition, a plurality of webs can be used with a single printer by increasing the number of tractor units, allowing the webs to be used selectively.

DESCRIPTION OF THE PREFERRED EMBODIMENTS

A preferred embodiment of the invention of the invention will now be described with reference to the attached drawings.

Figure 1A:
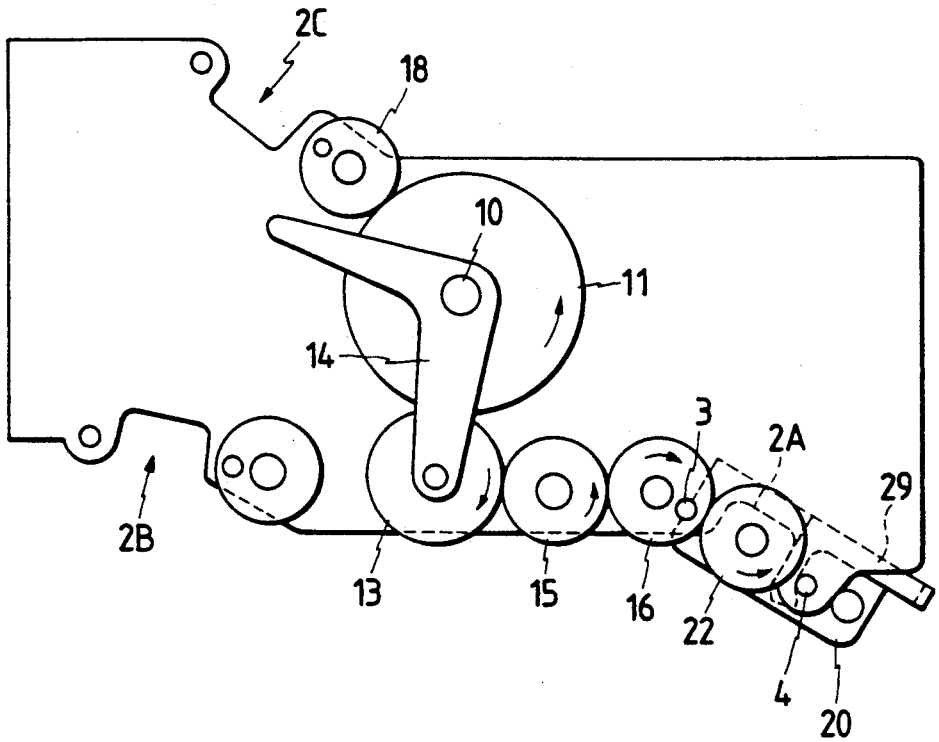
FIGS. 1(*a*) and 1(*b*) are side views showing the construction of a printer of a preferred embodiment of the invention.
Figure 1B:
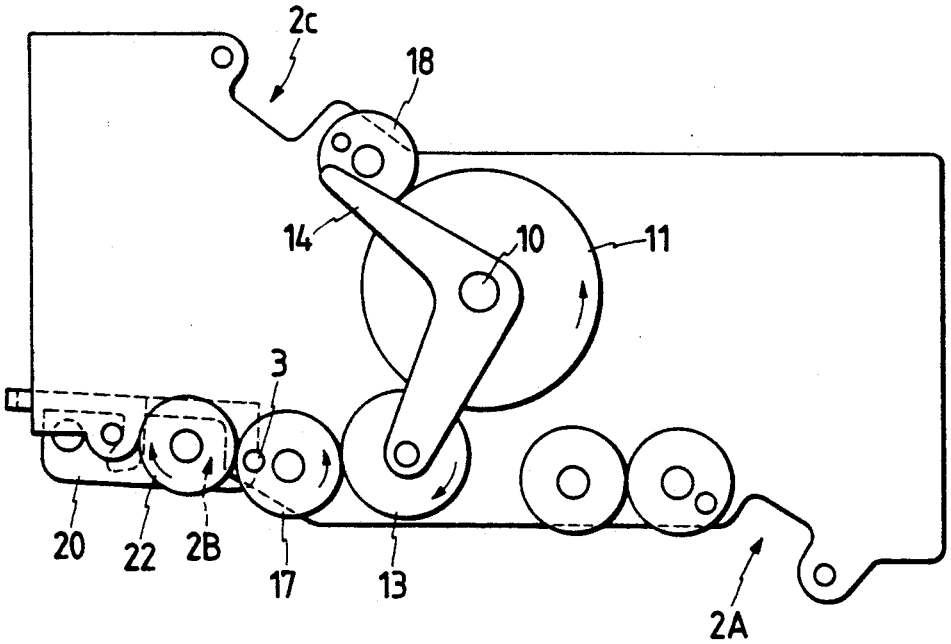

FIGS. 1(*a*) and 1(*b*) show a frame mechanism and a structure of wheels in tandem of a printer.

In these drawings, a frame 1 has a platen shaft 10 that is releasably supported in the middle part of the frame 1. Interposing the shaft supporting section, tractor unit mounting sections 2A, 2B and 2C are arranged at lower front and rear positions, or at an upper rear position if desired. Each of the tractor unit mounting sections can removably accommodate a tractor unit 20 (described later).

A switching lever 14 is rotatably and pivotally supported at one end of the platen shaft 10. The switching lever 14 pivotally supports a planetary gear 13 that engages a platen gear 11. Toward the front and rear of the frame 1 of the printer body are provided idler gears 15, 16 and 17 which are pivotally supported. The idler gears 15, 16 and 17 transmit a force for driving a tractor unit 20 mounted on one of the tractor unit mounting sections 2A and 2B through the planetary gear 13. If necessary, an idler gear 18 for transmitting a drive force to a tractor unit 20 mounted on the mounting section 2C is disposed at the upper rear position of the frame 1.

Figure 2:
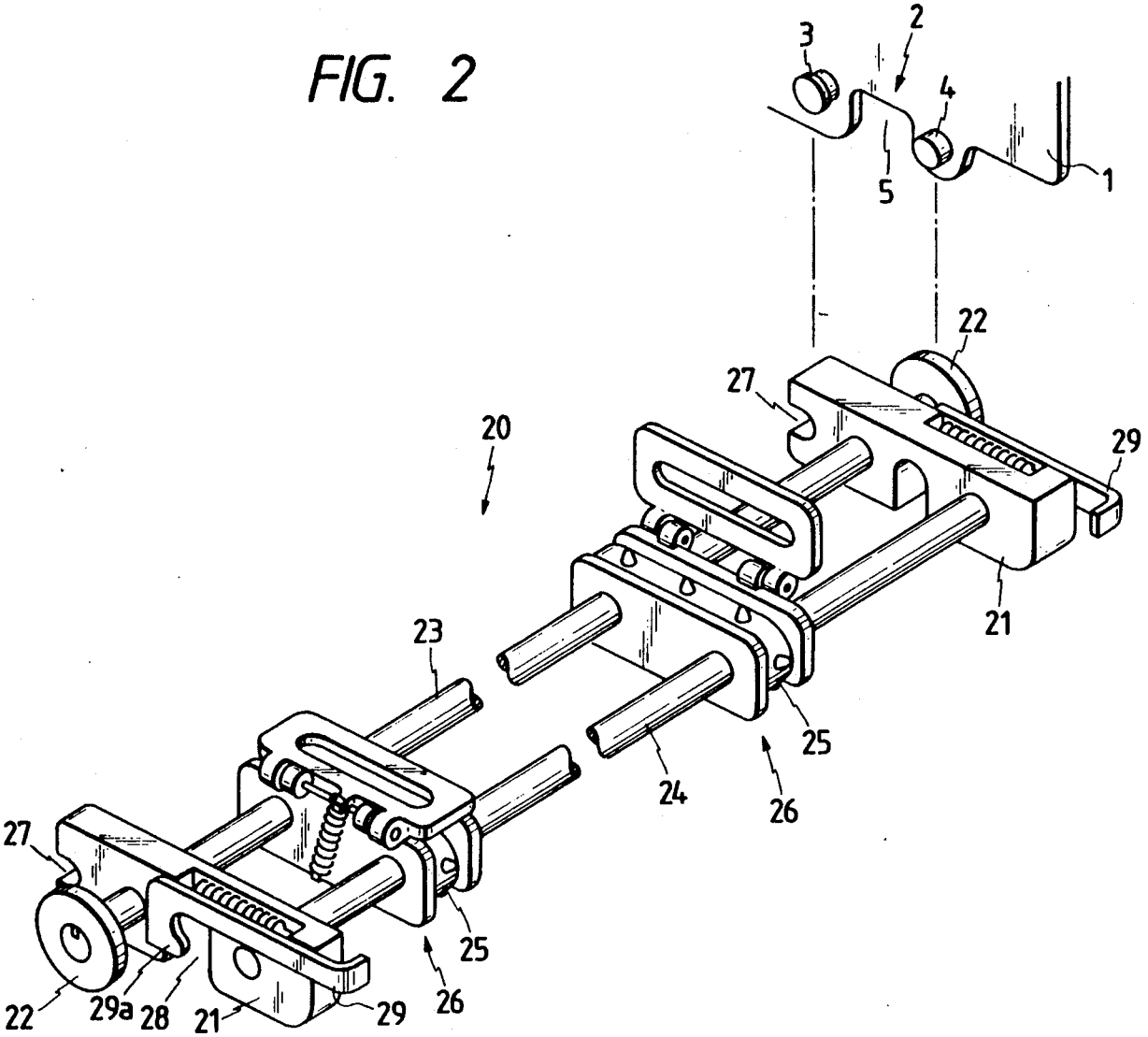
FIG. 2 is a perspective view showing a tractor unit used with the printer device of FIG. 1.
Figure 3B:
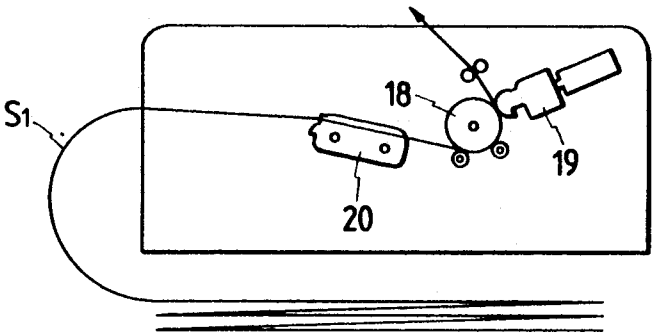
FIGS. 3(*a*) through 3(*d*) are diagrams illustrating different modes of mounting tractor units.
Figure 3D:
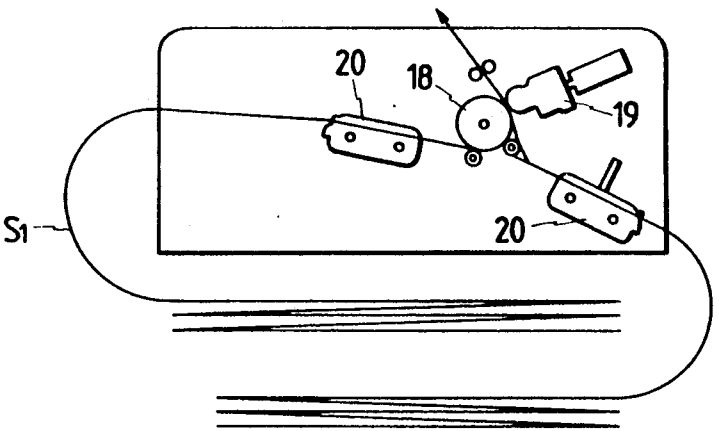
Figure 3A:
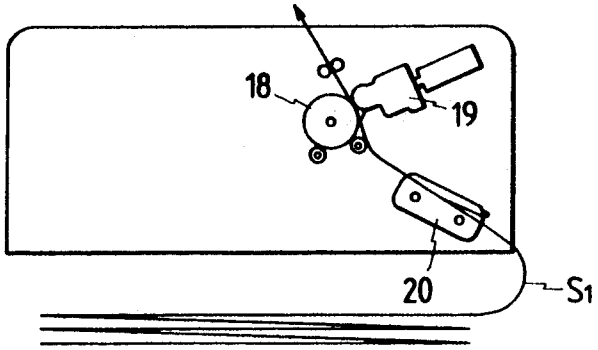
Figure 3C:
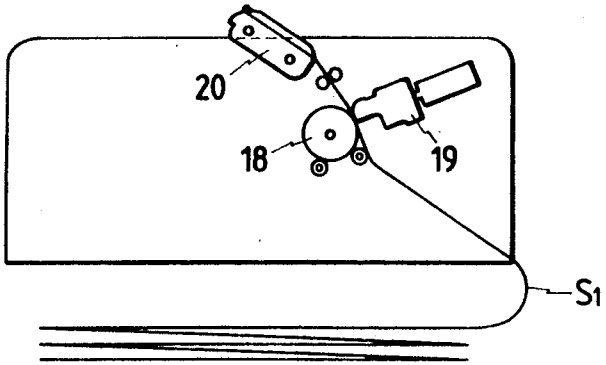

FIG. 2 shows the tractor unit 20 to be releasably mounted on the tractor unit mounting sections 2A, 2B and 2C. Unit frames 21 disposed at both ends in the width direction of the tractor unit 20 support a drive shaft 23 having drive gears 22 at its ends and a guide shaft 24. A pair of tractor sets 26, each having a tractor belt 25, is slidably mounted on the shafts 23 and 24. Each of the frames 21 has an engaging recessed portion 27 arranged at one end on the drive shaft 23 side. Each engaging recessed portion 27 is engageable with a positioning pin 3 located closer to the platen shaft 10 arranged on the tractor unit mounting section 2 of the frame 1. On the bottom side of each unit frame 21 is a deeply recessed portion 28 for receiving another positioning pin 4. The drive shaft 23 is inserted into a recess 5 arranged on the tractor unit mounting section 2 so that the positioning pins 3 and 4 are engaged with the engaging recessed portions 27 and 28, respectively. Each positioning pin 4 inserted into each engaging recessed portion 28 is embraced by a lock lever 29 biased outwardly by a spring s that the tractor unit 20 is positioned and fixed on the mounting section 2.

In FIG. 3, reference numeral 18 designates a platen, and 19, a print head.

In the printer thus constructed, a web $S_1$ may be selectively fed from the front of the printer in accordance with the conditions of installation of the printer. In this case, as shown in FIG. 1(*a*), the tractor unit 20 is mounted on the tractor unit mounting section 2A arranged at the lower front position of the frame 1 of the printer. Specifically, the engaging recessed portions 27 arranged at first ends of the unit frames 21 are engaged with the positioning pins 3 which are located closer to the platen shaft 10, and then the other positioning pins 4 are inserted into the deeply recessed portions 28 with the lock levers 29 moved toward the drive shaft 23 against the force of the spring. Then, the biasing forces of the lock levers 29 are released to hold pawls 29*a* arranged at the tips of the lock levers 29, and the tractor unit 20 is fixed on the mounting section 2A of the frame 1 with the drive gear 22 meshed with the idler gear 16.

Under this state, the switching lever 14 is turned counterclockwise (in FIG. 1(*a*)) to cause the planetary gear 13 mesh with the idler gear 15 in front of the frame 1. As a result, the printer is, as shown in FIG. 3(*a*), set up as a front-feed printer with the mounted tractor unit 20 serving as a push tractor.

To set up the printer as a rear-feed type, the tractor unit 20 is located in reverse from front to rear as shown in FIG. 1(*b*). The drive gear 22 of the tractor unit 20 is attached to the tractor unit mounting section 2B arranged at the lower rear position of the frame 1 of the printer body so as to mesh with the idler gear 17, and the switching lever 14 is turned clockwise (in FIG. 1(*b*)) to cause the planetary gear 13 to mesh with the idler gear 17 disposed at the rear of the frame 1. Accordingly, as shown in FIG. 3(*b*), the printer is set up as a rear-feed type.

Similarly, if the tractor unit 20 is mounted on the tractor unit mounting section 2C at the upper rear position as the case may require, the tractor unit 20 can be used as a pull tractor, as shown in FIG. 3(*c*), so that the web $S_1$ can be pulled onto the platen 18 from the front (or from the rear) of the printer.

Although not shown in FIGS. 3(*a*) and 3(*b*), another tractor unit 20 in addition to the tractor unit 20 may be mounted on the tractor unit mounting section 2A (or 2B) arranged at the lower front (or rear) position of the frame 1 of the printer body so that a printer using both a push/pull tractor-fed type can be set up.

Moreover, if two tractor units 20 are mounted on the tractor unit mounting section 2A or 2B at the lower front and rear positions of the frame 1 and the switching lever 14 is turned either clockwise or counterclockwise, the selected web $S_1$ will be fed to the platen 18, as shown in FIG. 3(*d*).

In the case where the invention is applied to a printer having a cut sheet feeder, the tractor unit 20 can be mounted at the lower front position so that the printer can select between cut sheet feeding and web feeding.

As described above, according to the invention, the printer includes at least two tractor unit mounting sections upstream of the print position in the sheet feed direction, and at least one tractor unit can be mounted on either of these tractor unit mounting sections. Therefore, the sheet feeding direction can be selected freely in accordance with the web replacement frequency or the printer installation location merely by changing the mounting position of the tractor unit. In addition, if the number of tractor units is increased, a plurality of webs can be set up simultaneously and used selectively.

What is claimed is:

1. A printer comprising: a frame having at least two tractor unit mounting sections disposed upstream of a printing position in said printer in a sheet feeding direction; means for selectively transmitting a drive force to each of said tractor unit mounting sections; at least one tractor unit; means for removably and interchangeably mounting said tractor unit on any selected one of said tractor unit mounting sections and coupling said drive force transmitting means to said tractor unit at the time said tractor unit is mounted.

2. The printer of claim 1, wherein said printer comprises a frame rotatably supporting a platen shaft supporting a platen and platen gear, and said means for transmitting a drive force comprises a switchable lever rotatably mounted on said platen shaft and a planetary gear rotatably mounted on an end portion of said lever and engaged with said platen gear.

3. The printer of claim 2, wherein said means for transmitting a drive force further comprises a plurality of idler gears, at least one of said idler gears being provided for each of said tractor unit mounting sections, said switchable lever being rotatable to engage said planetary gear with a selected one of said idler gears.

4. The printer of claim 1, wherein said frame has a recess formed therein, and wherein each of said tractor unit mounting sections comprises a pair of positioning pins disposed on opposed sides of said recess.

5. The printer of claim 4, wherein said tractor unit comprises a guide shaft, a drive shaft, at least one drive gear mounted at the end of said drive shaft, and a pair of unit frames disposed at opposite ends of said tractor unit and supporting said guide shaft and said drive shaft, each of said unit frames having a first recessed portion formed in an end part thereof, said first recessed portion being engageable with a respective one of said positioning pins of each of said tractor mounting selections on a side of said recess closer to said platen shaft, and each of said unit frames further having a second recessed portion formed in a bottom part thereof, said second recessed portion being engageable with the other of said positioning pins, each of said tractor unit mounting sections having an idler gear, said drive gear being engaged with said idler gear of a selected one of said tractor unit mounting sections when said tractor is mounted on said printer.

6. The printer of claim 5, wherein said tractor unit further comprises a spring-biased locking lever disposed adjacent said second recessed portions of said unit frames and engageable with said other of said positioning pins of said selected one of said tractor unit mounting sections when said tractor is mounted on said printer.

7. The printer of claim 1, wherein ones of said tractor unit mounting sections are respectively provided at positions below and forward of said platen, below and rearward of said platen, and above and rearward of said platen.

* * * * *